United States Patent [19]

Duckett

[11] Patent Number: 4,806,044

[45] Date of Patent: Feb. 21, 1989

[54] ANTI-CRASH LANE BARRIER WITH SELF-CENTERING HINGES

[75] Inventor: John W. Duckett, Sausalito, Calif.

[73] Assignee: Barrier Systems, Inc., Sausalito, Calif.

[21] Appl. No.: 196,435

[22] Filed: May 20, 1988

[51] Int. Cl.[4] ..... E01F 13/00; E01F 15/00

[52] U.S. Cl. ..... 404/6; 404/10; 404/12; 256/13.1; 52/600; 16/361

[58] Field of Search ..... 404/6, 9, 10, 12, 13; 256/1, 13.1; 52/600, 729; 16/239, 273, 361

[56] References Cited

U.S. PATENT DOCUMENTS

| | | | |
|---|---|---|---|
| 960,740 | 6/1910 | Vaughn | 52/729 |
| 2,841,059 | 7/1958 | Wiswell | 404/13 |
| 3,531,823 | 10/1970 | Cornelius | 16/361 |
| 3,666,332 | 5/1987 | Burgett | 404/6 |
| 4,105,353 | 8/1978 | Bork et al. | 404/6 X |
| 4,376,594 | 3/1983 | Prosenz | 404/6 |
| 4,435,106 | 3/1984 | Forster et al. | 404/6 |
| 4,474,503 | 10/1984 | Booth et al. | 404/6 |
| 4,496,264 | 1/1985 | Casey | 404/6 |
| 4,500,225 | 2/1985 | Quittner | 404/13 X |
| 4,502,812 | 3/1985 | Zucker | 404/6 |
| 4,547,929 | 10/1985 | Lew et al. | 16/361 X |
| 4,661,010 | 4/1987 | Almer et al. | 404/6 |

FOREIGN PATENT DOCUMENTS

| | | | |
|---|---|---|---|
| 559969 | 7/1958 | Canada | 404/12 |
| 431594 | 8/1967 | Switzerland | 256/13.1 |

*Primary Examiner*—Jerome W. Massie
*Assistant Examiner*—John F. Letchford
*Attorney, Agent, or Firm*—Phillips, Moore, Lempio & Finley

[57] ABSTRACT

A lane barrier system comprises a plurality of pivotally interconnected modules adapted to be transferred on a roadway. Each module has sidewalls that taper upwardly and inwardly to intersect a T-shaped upper portion having undercut surfaces extending laterally outwardly from a central vertical axis of the module and past critical impact points on the module. The sidewalls and undercut surfaces are configured to aid in the precise deflection, guidance and "capturing" of the bumper of a passenger vehicle or light duty truck when the bumper impacts the module to prevent the vehicle from catapulting over the system. A reinforcement assembly is encased within a concrete casting of each module. Each adjacent pair of modules are pivotally connected together to permit them to elongate or contract to assume a composite varied length different than a normal, nominal length when a load is imposed thereon and to automatically return to their nominal length when the load is removed. This controlled elongation or contraction of the lane barrier is particularly advantageous when the barrier is positioned at various radii on a curved roadway.

28 Claims, 3 Drawing Sheets

ANTI-CRASH LANE BARRIER WITH SELF-CENTERING HINGES

TECHNICAL FIELD

This invention relates to a lane barrier system for roadways and more particularly to a transferable lane barrier having a plurality of pivotally interconnected modules adapted to be lifted and moved to various locations on a roadway or the like by a transfer vehicle.

BACKGROUND OF THE INVENTION

U.S. Pat. Nos. 4,498,803, 4,500,225 and 4,624,601 disclose a transferable lane barrier system for roadways adapted to be lifted by a transfer vehicle and moved to a selected position on a roadway or the like. Lane barriers of this type find particular application at roadway construction sites and on roadways and bridges wherein the groupings of incoming and outgoing lanes of traffic must be varied, particularly during commute hours.

Prior to the advent of the lane barrier system disclosed in the above patents, lane barrier systems used at construction sites normally constituted individual, steel-reinforced concrete modules. The modules, arranged in tandem relationship, were and still are used to separate lanes of traffic from a construction area for safety purposes. The modules require the use of cranes and the like to selectively place and remove the modules. This procedure is obviously time consuming, labor intensive and expensive to use.

In respect to commuter lanes and bridges that exhibit a high propensity for head-on collisions, the lane barrier system disclosed in the above patents has provided a solution to the long-standing need for providing an effective and transferable crash barrier separating incoming and outgoing lanes of traffic. Prior to the advent of this lane barrier system, lanes of traffic were solely divided by flimsy delineators or posts that provided no protection against head-on collisions.

For example, the Golden Gate Bridge in San Francisco and its connector, Doyle Drive, are even now using upstanding plastic posts having pins secured on their lower ends to facilitate transfer of the posts from lane to lane to accommodate changes in commute hour traffic. This system has proved inadequate for protecting against head-on collisions, as evidenced by four fatalities and numerous injuries that have occurred during the first four months of 1988. Further, minimal protection is provided for the workmen required to change the posts from lane-to-lane from a truck.

The lane barrier system disclosed in the above patents has worked quite well when placed in operation to prevent a passenger car from leaving its lane when it impacts the barrier system. The present invention provides an improved lane barrier system in respect to its ability to prevent a passenger car or the like from riding or catapulting over the modules thereof. In particular, applicant has determined that consideration should be given to the profile design of the module's sidewalls and reinforcement, relative to the configuration of the bumper systems of passenger vehicles and light duty trucks.

Conventional bumper systems are normally the first portion of a vehicle to impact the barrier system, as evidenced by extensive experimental tests conducted thereon. The Society of Automotive Engineers, Inc. has issued SAE Standard J689 which recommends standards for the bumper systems for passenger cars, station wagons and light duty trucks. In particular, under full rated load, the minimum approach, departure and ramp brakeover angles of such a vehicle are recommended as 16°, 10° and 10°, respectively. Further, SAE recommended practice J980a sets forth a bumper evaluation test procedure for passenger vehicle bumper systems.

In addition to addressing the above-described anti-crash problem, another aspect of this invention solves the long standing problem of providing a lane barrier system that will elongate or contract to accommodate positioning of the system at varied radii on a curved roadway. The system disclosed in the above patents, particularly useful for straight-line roadway applications, utilizes a hinge connection between each adjacent pairs of modules having aligned circular holes, formed in overlying hinge plates, adapted to receive a hinge pin therethrough. Even when the holes are lined with a thin (e.g., $\frac{1}{8}''$ wall thickness) elastomeric bushing, the modules are incapable of elongating as a unit when the system is moved radially on a curved roadway.

For example, it has been determined that when the system is moved from a 1200 ft. radius to a 1212 ft. radius, the composite length of the lane barrier system must increase by approximately 0.25 in. for each three feet in length of the barrier system to effectively accommodate this new position on the same, curved roadway. Conversely, repositioning of the barrier system radially inwardly to a new position on the curved roadway, having a radius of curvature of 1188 ft., will require a corresponding contraction of the composite length of the lane barrier system. In the above example, it should be understood that the ends of the barrier system are located at the same relative radial position on the curved roadway to thus require the aforementioned composite elongation or retraction of the system.

One solution to the latter problem of compensating for curvatures of varied radii on a curved roadway is to substitute elongated slots for the pin-receiving circular holes, normally formed in the hinge plates. The slots allow the lane barrier system to assume various radii, as described in the above example. However, it is further desirable to return the spacing between each adjacent pair of modules to a nominal one when the barrier system is loaded on a transfer vehicle and returned to its normal position on a roadway, e.g., the above-mentioned radius of 1200 ft.

Repeated transfer of the modules having slotted hinge pins will tend to "stack-up" the modules towards one of the ends of the lane barrier system which interferes with effective transfer and placing of the modules in their correct positions. In particular, it is desirable to maintain the pivot pin between each adjacent pair of modules at a centered position therebetween (and reestablish the nominal spacing) when the barrier system is returned to its nominal position on a roadway. This feature, when achieved, will facilitate the efficient transfer of the system by the type of transfer apparatus described in the above patents.

SUMMARY OF THE INVENTION

An object of this invention is to provide an improved lane barrier system for roadways and the like that overcomes the above, briefly described problems.

The lane barrier system comprises at least one upstanding module having base, upper and mid portions. When viewed in cross-section, the base portion comprises outer first sidewalls extending upwardly to converge towards a vertically disposed central axis of the module, at an included acute first angle. The mid portion comprises outer second wall portions extending upwardly from the first sidewalls to converge inwardly towards the central axis at an included acute second angle less than the first angle and outer third sidewalls extending upwardly from points of intersection with the second sidewalls, at an included acute third angle greater than the second angle. The upper portion of the module is T-shaped to comprise outer fourth sidewalls extending upwardly from the third sidewalls and intersecting undercut surfaces extending laterally outwardly from the central axis of the module and past the points whereat the second and third sidewalls intersect.

This configuration of the module provides that when it is impacted with the bumper of a passenger vehicle for example, that the vehicle's bumper will be deflected and guided in a closely controlled manner upwardly and longitudinally into "captured" relationship under one of the undercut surfaces formed on the aligned T-shaped upper portions of the modules. Thus, the vehicle will be guided longitudinally along the outside of the interconnected modules of the lane barrier system and will be prevented from riding or catapulting over the modules for possible head-on collision with a vehicle approaching from the opposite direction.

In another aspect of this invention, each module is composed of a uniquely arranged reinforcement assembly, encased within a concrete casting, to provide a high degree of structural integrity and stability to the module.

In still another aspect of this invention, each adjacent pair of modules normally assume a composite nominal length. Connecting means connects the modules together for relative pivotal movement about a vertical pivot axis for permitting the modules to: (1) elongate or contract to assume a composite varied length different from their nominal length in response to the imposition of a load on the lane barrier system, and (2) return the modules to their nominal length when the load is removed.

This feature of the invention is particularly advantageous when the lane barrier system is positioned on a curved roadway and is moved from its nominal position, defined by a nominal radius, and is thereafter moved either radially outwardly or radially inwardly to a position defined by a different radius. When so moved, the connecting means will allow the composite length (arc of a near circle) of the modules to change, but will function to automatically return the lane barrier system to its original nominal length when loaded on a transfer vehicle for replacement purposes.

BRIEF DESCRIPTION OF THE DRAWINGS

Other objects and advantages of this invention will become apparent from the following description and accompanying drawings wherein.

DESCRIPTION OF THE PREFERRED EMBODIMENT

FIGS. 1–4 illustrate a module 10 adapted to be hingedly connected to identical modules to form a lane barrier system of the type disclosed in above-referenced U.S. Pat. Nos. 4,498,803, 4,500,225 and 4,624,601. As described in these patents, the lane barrier system is adapted to be transferred from a first position to a laterally displaced second position at a construction site or on a roadway to delineate and provide an anticrash barrier between lanes thereof. In particular, a wheeled road vehicle (not shown) has a transfer mechanism mounted thereon whereby the lane barrier system can be moved serpentine in chain-like fashion from one side of the vehicle to the other side for repositioning the system to a new position on a roadway. Since the vehicle and transfer mechanism, as well as the method for moving the system, do not form a direct part of this invention, further discussions thereon are deemed unnecessary for a full understanding of this invention.

One unique aspect of this invention is the ability of module 10 to deflect and guide a passenger vehicle or the like along a confronting side of the module without permitting the vehicle to run or catapult over the module. When impact occurs, the vertical center of the front bumper assembly of a standard passenger vehicle, for example, is normally positioned approximately eighteen to twenty inches above road level. As discussed above in respect to SAE Standard J689, the approach, ramp brakeover and departure angles of a standard passenger car, station wagon or light duty truck are 16°, 10° and 10°, respectively.

Figure 2:
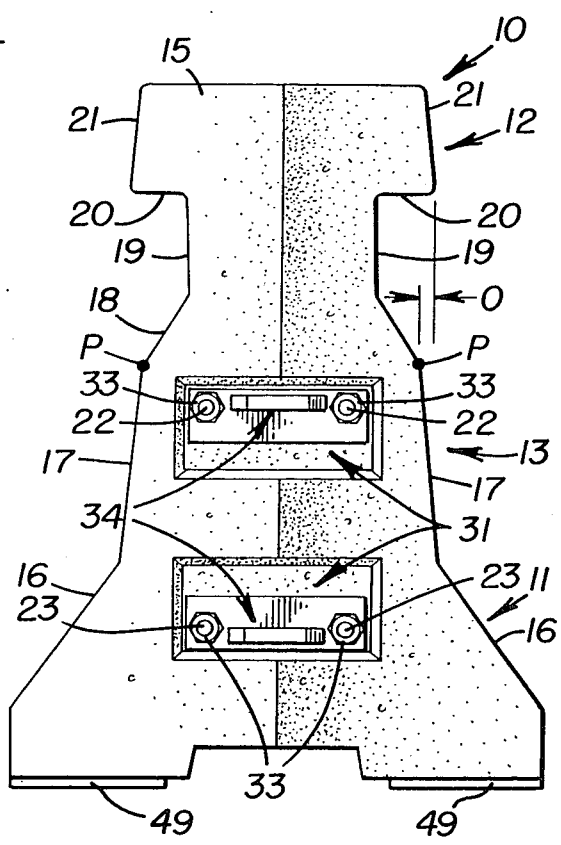
FIG. 2 is an end elevational view of the module, taken in the direction of arrows II—II in FIG. 1.
Figure 4:
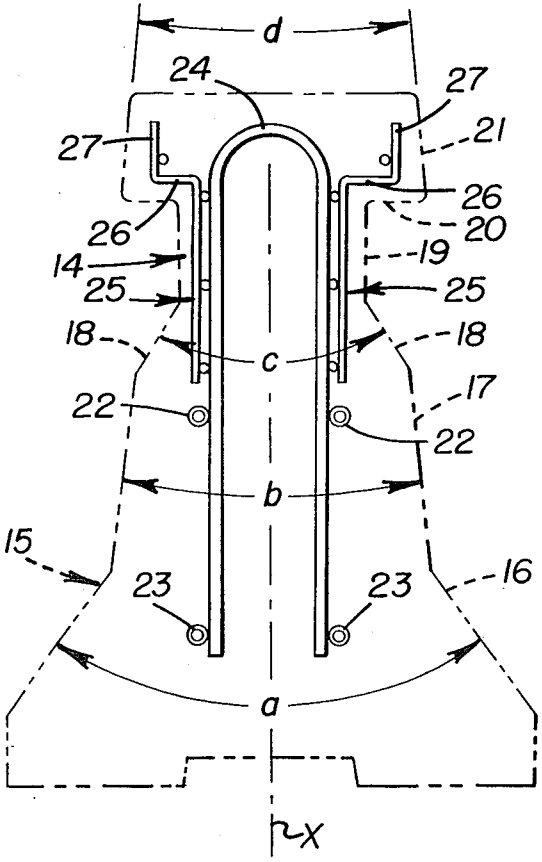
FIGS. 3 and 4 are views similar to FIGS. 1 and 2, respectively, but illustrate a steel reinforcement assembly encased within the module with a concrete casting of the module being shown in phantom lines.
Figure 3:
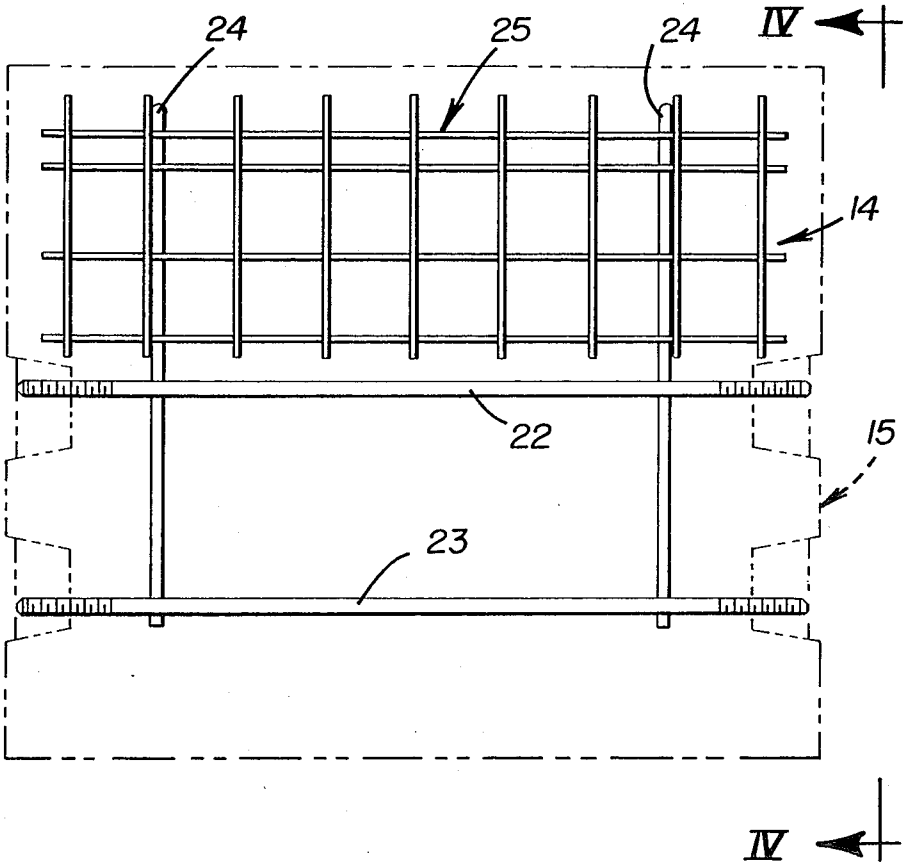

Referring to FIG. 2, upstanding module 10 includes a base portion 11, a T-shaped upper portion 12 and a mid-portion 13 formed between the base and upper portions. Referring briefly to FIGS. 3 and 4, the module is constructed to have a steel reinforcement assembly 14 encased within a concrete casting 15. In one commercial application, each module weighs approximately 1400 lbs. and has a height of 32.0 in., a base width of 24.0 in., a top width of 12.56 in., and a length of 37.0 in.

Referring to FIGS. 2 and 4, when the module is viewed in cross-section, base portion 11 includes a pair of sloped outer sidewalls 16 extending upwardly to converge towards a vertically disposed central axis X of the module at an included acute first angle a, shown as approximating 70. Mid-portion 13 of the module comprises sloped outer sidewalls 17 extending upwardly from their intersections with sidewalls 16 to converge inwardly towards axis X at an included angle "b", less than angle "a" and shown as approximating 14°. Mid-portion 13 further comprises outer sidewalls 18 extending upwardly from points of intersection P with sidewalls 17, at an included acute angle "c" (approximately 60°) greater than angle "b".

Upper portion 12 comprises parallel outer sidewalls 19 and intersecting undercut surfaces 20, extending laterally outwardly from axis X and past points P. Thus, an overhang O is provided by surfaces 20, relative to points P depicting the intersections of sidewalls 17 with sidewalls 18. Additional sidewalls 21 of upper portion 12 extend upwardly from the outer boundaries of surfaces 20 at an included acute angle "d" approximating angle "b".

From the above description, it can be seen that the impact of a bumper or other portion of a vehicle against a side of the module, adjacent to point P (positioned approximately nineteen inches above road level in the above-mentioned commercial embodiment of the module), will cause the bumper to deflect and ride upwardly and be guided longitudinally into captured relationship under aligned undercut surfaces 20. Further, the interrelated and cooperating dispositions of sidewalls 1 6, 17 and 18 will aid in reducing the lateral force vector imposed on the module to aid in retaining it in position on a roadway.

In addition to providing the anti-crash function, the T-shaped configuration of upper end 12 of the module provides transfer means formed in unobstructed relationship on lateral sides of the module and longitudinally throughout the entire length thereof. Undercut surfaces 20 of the transfer means are adapted to engage over and be lifted by rollers of a transfer apparatus of a vehicle (not shown), fully described in the above-referenced patents. The modules are hingedly connected together, as described hereinafter, to enable the modules to be lifted from a first position on a roadway, moved serpentine-like generally transversely across the vehicle and deposited at a second position on the roadway and on the other side of the vehicle.

Referring to FIGS. 3 and 4, another aspect of this invention comprises the construction and arrangement of steel reinforcement assembly 14, encased within concrete casting 15. The assembly comprises vertically spaced pairs of longitudinally extending and laterally spaced tie rods 22 and 23, each externally threaded on opposite ends thereof for purposes described hereinafter. The tie rods are welded or otherwise suitably secured to at least one pair of longitudinally spaced and vertically disposed inverted U-shaped stiffeners 24.

A pair of generally vertically disposed and longitudinally extending steel mesh reinforcements 25 are welded or otherwise suitably secured to the upper ends of stiffeners 24, above the tie rods. As shown in FIG. 4, each steel mesh reinforcement includes a laterally displaced horizontal portion 26 that parallels a respective surface 20 and a vertically disposed portion 27 that generally parallels a respective sidewall 21 of upper end 12 of the module. This reinforcement in the upper end of the module aids in the above-described anti-crash desiderata and greatly enhances the structural integrity thereof.

Referring to FIGS. 1, 2, 5 and 6, each adjacent pair of modules 10 are hingedly connected together for relative pivotal movement about a vertical pivot axis Y of a hinge pin 28. As described more fully hereinafter, the modules are disposed in closely spaced and tandem relationship relative to each other to normally assume a composite nominal length whereat minimal loads are imposed on the modules and hinge connections.

Figure 5:
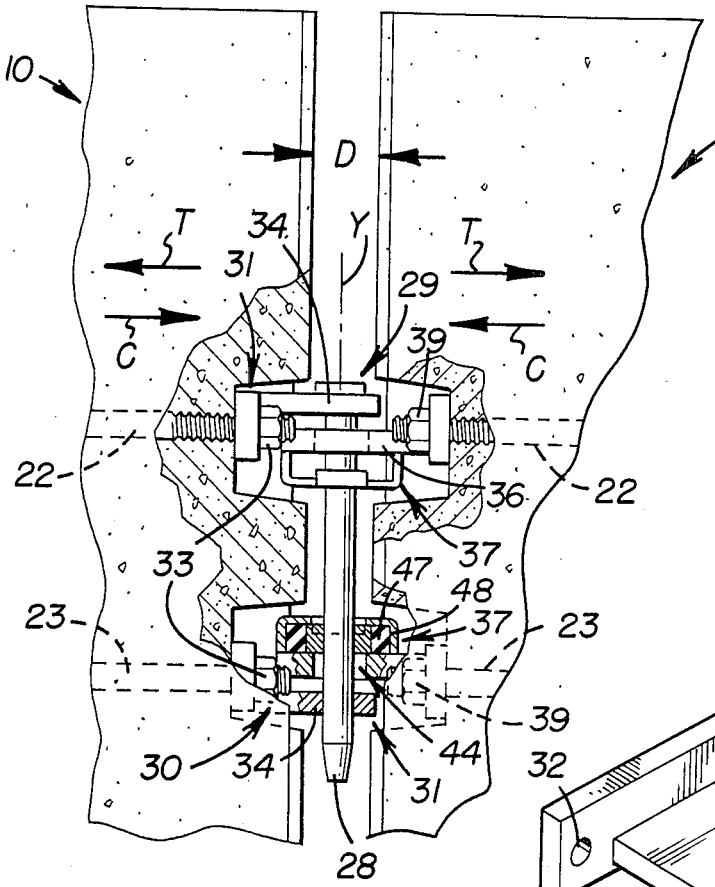
FIG. 5 is an enlarged side elevational view, partially illustrating a pair of adjacent modules of a lane barrier system and a hinge connection therebetween.
Figure 6:
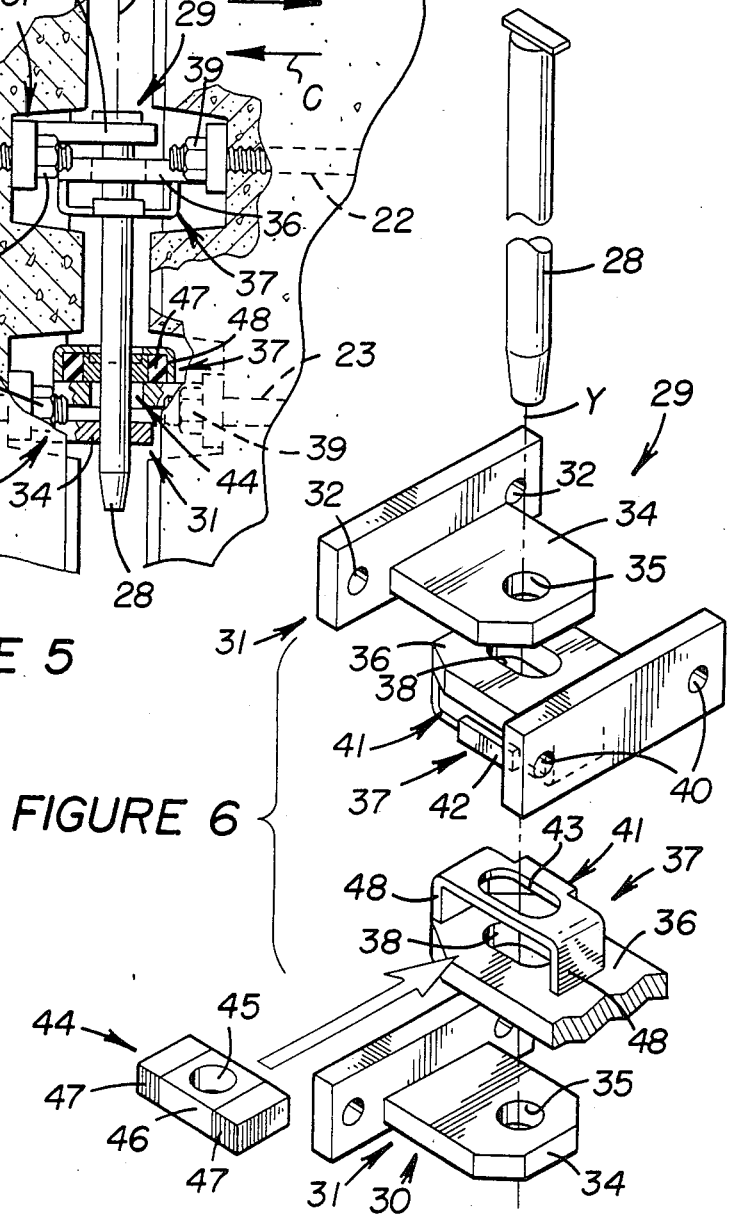
FIG. 6 is an exploded isometric view of the hinge connection.

The typical hinge connection illustrated in FIGS. 5 and 6 connects each pair of adjacent modules together for relative pivotal movement about axis Y and also permits the modules to: (1) elongate or contract to assume a composite varied length different from their normal, nominal length in response to imposition of a load (tensile or compressive) on the lane barrier; and (2) automatically return the modules to their nominal length when the load is removed from the lane barrier. Otherwise stated, and referring to FIG. 5, when the lane barrier assumes its composite nominal length, a nominal separation distance D is defined therebetween. During such condition, pivot axis Y of hinge pin 28 is disposed intermediate the modules.

When the lane barrier system elongates and is tensioned in response to the imposition of a load thereon, separation distance D will widen. The tensile load is depicted by arrows T for explanation purposes. Conversely, when the modules contract and are compressed towards each other in response to the imposition of an oppositely directed load (depicted by arrows C), separation distance D will narrow. As described above, the ability of the hinge connection illustrated in FIGS. 5 and 6 to compensate for relative elongation or contraction of the lane barrier system permits it to effectively assume various radii on a curved roadway.

Figure 1:
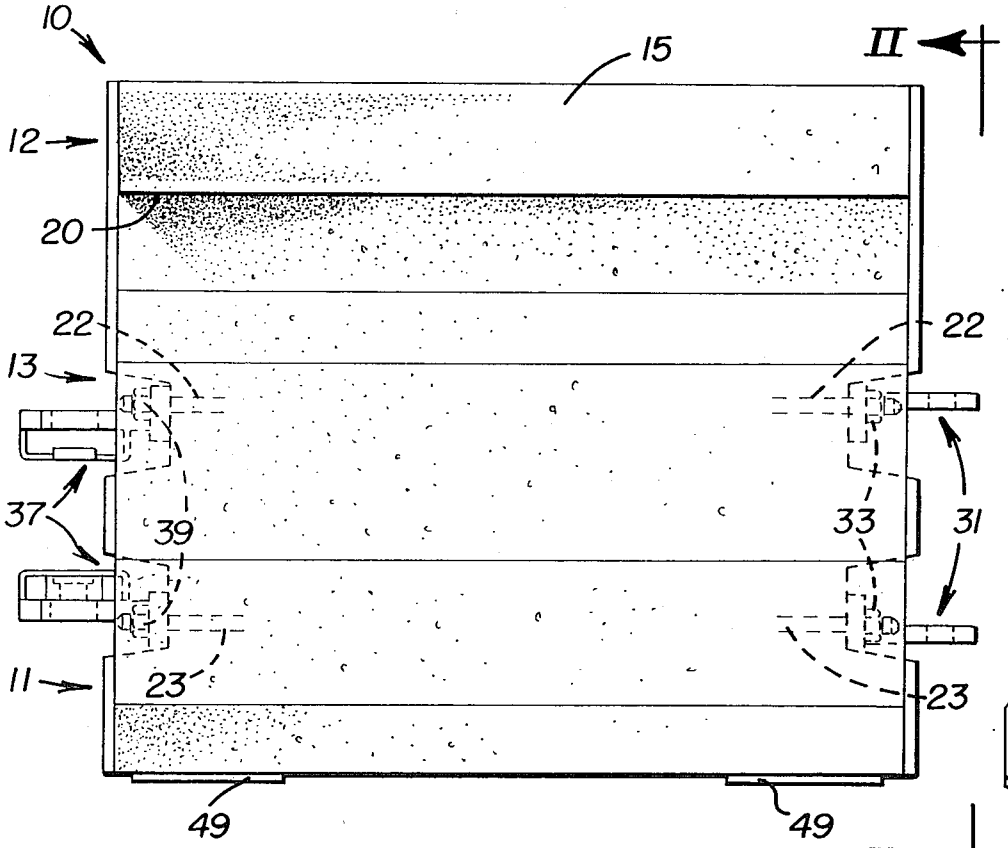
FIG. 1 is a side elevational view of a module used in a lane barrier system of this invention with the opposite side being a mirror image of the side shown.

The hinge connection comprises an upper hinge 29 vertically aligned with a lower hinge 30 with pivot axis Y of hinge pin 28 being common to the two hinges. As shown, the basic components of the upper and lower hinges are identical, except that they are inverted relative to each other. Hinge connection 29, for example, comprises a bracket 31 having a pair of laterally spaced holes 32 formed therethrough for mounting on the threaded ends of upper tie rods 22. The bracket is secured on the rods by nuts 33 (FIGS. 1, 2 and 5). A hinge plate 34 extends outwardly from the bracket and has a vertically aligned hole 35 formed therethrough for receiving pin 28. Hinge plate 34 overlies a hinge plate 36 of a second bracket 37. Hinge plate 36 has a longitudinally disposed, elongated slot 38 formed therethrough in center alignment with hole 35.

Bracket 37 is secured to laterally spaced upper tie rods 22 of the next adjacent module by a pair of nuts 39 with the threaded ends of the rods extending through a pair of laterally spaced holes 40 formed through bracket 37. It should be noted in FIGS. 1, 2 and 5 that the threaded ends of rods 22 and 23 and portions of the attached brackets are recessed within the module. Bracket 37 has a cage 41 secured on one side thereof with a stop lug 42 being formed on one lateral side of the bracket for purposes described hereinafter. An elongated slot 43 is formed through the horizontal portion of cage 41 in vertical alignment with slot 38. As further shown in FIGS. 5 and 6, when pairs of brackets 31 and 37 of hinge 29 and 30 are positioned in overlying relationship relative to each other, holes 35 will be positioned vertically, intermediate the ends of slots 38 and 43.

As stated above, lower hinge 30 is substantially identical to upper hinge 29, except that the lower hinge has a pusher plate assembly 44 added thereto. The pusher plate assembly is mounted on plate 36 and within cage 41. Stop lug 42 functions to precisely vertically align a hole 45 of the pusher plate assembly with holes 35 of brackets 31.

Pusher plate assembly 44 comprises a steel block 46 having elastomeric members suitably bonded to opposite ends thereof. As shown in FIG. 5, each elastomeric member closely abuts a respective end wall 48 of cage 41. Thus, relative movement of the modules in the direction of arrows C or T in FIG. 5 will function to compress one of the elastomeric pads 47 to permit the modules to elongate or contract, both under a biasing force exerted on pin 28 by pads 47 for the purposes described above.

It should be further noted in FIGS. 5 and 6 that hinge pin 28 is closely fitted within holes 35 and 45. The lengths of identically sized slots 38 and 43 are such so as to provide stop means for preventing the elastomeric pads from "bottoming-out" which could result in compressive failure of the elastomer. It should be understood that although pusher plate assembly 44 is shown added only to lower hinge 30, that it could be added only to upper hinge 29 or to both hinges.

Elastomeric pads 47 may be composed of any suitable elastomeric material exhibiting the desired physical and chemical properties for the purposes described herein. For example, the pads may be composed of a suitable non-degradable natural rubber, synthetic rubber, silicone rubber or the like. Hytrel polyester elastomers, for example, exhibit high degrees of impact resistance, load bearing capacity, resiliency, resistance to flex fatigue and tear and impact resistance. Such elastomer also exhibits high resistance to abrasion and grease contamination. Resilience of this material ranges from over 60% at a durometer A hardness of 90 to 50% at a durometer D hardness of 55. Skid plates 49 (FIGS. 1 and 2), secured to the underside of base portion lI of the module, may be composed of a similar elastomeric material if so desired.

I claim:

1. A lane barrier system comprising at least one pair of upstanding first and second modules disposed in closely spaced and tandem relationship relative to each other to normally assume a composite nominal length and connecting means connecting said modules together for relative pivotal movement about a common, single vertical pivot axis and for permitting said modules to: (1) Elongate or contract, both under a biasing force, to assume a composite varied length different from said nominal length in response to the imposition of a load on said lane barrier system, and (2) Automatically return to their nominal length under said biasing force when said system either elongates or contracts and when said local is removed from said lane barrier system.

2. The lane barrier system of claim 1 wherein said connecting means comprises elastomeric pad means for being placed in compression in response to elongation or contraction of said lane barrier system.

3. The lane barrier system of claim 2 wherein in said connection means comprises vertically spaced upper and lower hinges and wherein said elastomeric pad means is mounted in at least one of said hinges.

4. The lane barrier system of claim 3 wherein a said elastomeric pad means is mounted in each of said upper and lower hinges.

5. The lane barrier system of claim 1 wherein said connection means comprises a cylindrical hinge pin disposed on said pivot axis and having a predetermined outer diameter, a first bracket secured to said first module and having a vertically disposed hole formed therethrough substantially conforming to the diameter of said hinge pin and a second bracket secured to said second module in vertical alignment with said first bracket and having an elongated slot formed therethrough that is larger than the diameter of said hinge pin in the direction of an nominal length and wherein said elastomeric pad means is mounted on said second bracket and wherein said hinge pin extends through said hole and said slot.

6. The lane barrier system of claim 5 wherein said elastomeric pad means comprises a block having an elastomeric pad secured on each opposite end thereof and wherein said second bracket comprises a cage having said elastomeric pad means mounted therein with said pads engaging opposite ends of said cage.

7. The lane barrier system of claim 6 wherein a vertically disposed hole is formed through said block and substantially conforms to the diameter of said hinge pin which further extends therethrough.

8. The lane barrier system of claim 7 wherein a slot is formed through said cage in alignment with said first-mentioned slot and wherein said hinge pin extends through each of said holes and slots.

9. The lane barrier system of claim 7 further stop means on said cage for centering said holes on said pivot axis when said pad means is mounted in said cage.

10. A lane barrier system comprising at least one pair or upstanding first and second modules disposed in closely spaced and tandem relationship relative to each other to normally assume a composite nominal length and connecting means connecting said modules together for relative pivotal movement about a vertical pivot axis and for permitting said modules to: (1) Elongate or contract to assume a composite varied length different from said nominal length in response to the imposition of a load on said lane barrier system, and (2) Automatically return to their nominal length when said load is removed from said lane barrier system, said connection means comprising a cylindrical hinge pin disposed on said pivot axis and having a predetermined outer diameter, a first bracket secured to said first module and having a vertically disposed hole formed therethrough substantially conforming to the diameter of said hinge pin and a second bracket secured to said second module in vertical alignment with said first bracket and having an elongated slot formed therethrough that is larger than the diameter of said hinge pin in the direction of said nominal length and elastomeric pad means is mounted on said second bracket and wherein said hinge pin extends through said hole and said slot.

11. A lane barrier system comprising at least one upstanding module having a base portion, an upper portion and a mid-portion between said base and upper portions, when said module is viewed in cross-section, said base portion comprising outer first sidewalls extending upwardly to converge towards a vertically disposed central axis of said module at an included acute first angle, said mid-portion comprising outer second sidewalls extending upwardly from said first sidewalls to converge inwardly towards said axis at an included acute second angle less that said first angle and outer third sidewalls extending upwardly from points of intersection with said second sidewalls at an included acute third angle greater than said second angle, and said upper portion being T-shaped to comprise outer fourth sidewalls extending upwardly from said third sidewalls and intersecting undercut surfaces extending laterally outwardly from said axis and past the points of intersection of said second and third sidewalls, and a reinforcement assembly encased within a concrete casting defining each of said sidewalls thereon and wherein said reinforcement assembly comprises a plurality of longitudinally extending and laterally spaced tie rod each having threaded opposite ends exposed beyond opposite ends of said module and adapted to have hinge plates attached thereto.

12. The lane barrier system of claim 11 wherein said points of intersection are positioned within the approximate range of from eighteen to twenty inches above the lower end of said base portion.

13. The lane barrier system of claim 11 wherein said first angle approximates 70°, said second angle approximates 14° and said third angle approximates 60°.

14. The lane barrier system of claim 13 wherein and fourth side walls disposed in parallel relationship relative to each other.

15. The lane barrier system of claim 11 wherein said reinforcement assembly further comprises at least one pair of longitudinally spaced and vertically disposed inverted U-shaped stiffeners secured to each of said tie rods, and a pair of generally vertically disposed and longitudinally extending mesh reinforcements secured to said stiffeners.

16. The lane barrier system of claim 15 wherein said mesh reinforcements are secured to opposite outer sides of said stiffeners and wherein each of said mesh reinforcements includes a first portion extending in parallel relationship relative to a respective one of said undercut surfaces and a second portion extending upwardly therefrom.

17. The lane barrier system of claim 11 further comprising transfer means formed on said module for receiving and engaging a transfer apparatus to enable said module to be lifted from a first position on a roadway and deposited at a second position on said roadway.

18. The lane barrier system of claim 17 wherein said transfer means comprises the undercut surfaces of the upper portion of said module.

19. The lane barrier system of claim 17 further comprising one pair of upstanding first and second of said modules disposed in closely spaced and tandem relationship relative to each other to normally assume a composite nominal length and connecting means connecting said modules together for relative pivotal movement about a vertical pivot axis and for permitting said modules to:

(1) Elongate or contract to assume a composite varied length different from said nominal length in response to the imposition of a load on said lane barrier system, and (2) Automatically return to their nominal length when said load is removed from said lane barrier system.

20. The lane barrier system of claim 19 wherein said connecting means comprises elastomeric pad means for being placed in compression in response to elongation or contraction of said lane barrier system.

21. The lane barrier system of claim 20 wherein said connection means comprises vertically spaced upper and lower hinges and wherein said elastomeric pad means is mounted in at least one of said hinges.

22. The lane barrier system of claim 19 wherein said connection means comprises a cylindrical hinge pin having predetermined diameter, a first bracket secured to said first module and having a vertically disposed hole formed therethrough substantially conforming to the diameter of said hinge pin and a second bracket secured to said second module in vertical alignment with said first bracket and having an elongated slot formed therethrough that is larger than the diameter of said hinge pin and wherein said elastomeric pad means is mounted on said second bracket.

23. The lane barrier system of claim 22 wherein said elastomeric pad means comprises a block having an elastomeric pad secured to each opposite end thereof and wherein said second bracket comprises a cage having said elastomeric pad means mounted therein with said pads engaging opposite ends of said cage.

24. A lane barrier system comprising at least one upstanding module having a base portion, an upper portion and a mid-portion between said base and upper portions, said module composed of a reinforcement assembly encased within a concrete casting, said reinforcement assembly comprising vertically spaced pairs of longitudinally extending and laterally spaced tie rods each threaded on opposite ends thereof for securance of a hinge plate thereto, at least one pair of longitudinally spaced and vertically disposed inverted U-shaped stiffeners secured to each of said tie rods, and a pair of generally vertically disposed and longitudinally extending mesh reinforcements secured to said stiffeners.

25. The lane barrier system of claim 24 wherein said mesh reinforcements are secured to opposite outer sides of said stiffeners and wherein each of said mesh reinforcements includes a first portion extending horizontally into said upper portion and a second portion extending upwardly from said first portion.

26. The lane barrier system of claim 24 wherein said mesh reinforcements are disposed vertically above said tie rods.

27. The lane barrier system of claim 24 further comprising recesses formed in said concrete casting at each end of said module and wherein each end of said tie rods is positioned in a respective one of said recesses.

28. The lane barrier system of claim 27 further comprising a hinge plate secured to each end of each of said tie rods and substantially disposed in a respective one of said recesses.

* * * * *